US009534503B2

(12) United States Patent
Isogai

(10) Patent No.: US 9,534,503 B2
(45) Date of Patent: Jan. 3, 2017

(54) ROTARY MACHINE

(75) Inventor: Tomoyuki Isogai, Toyota (JP)

(73) Assignee: TOYOTA JIDOSHA KABUSHIKI KAISHA, Aichi-ken (JP)

( * ) Notice: Subject to any disclaimer, the term of this patent is extended or adjusted under 35 U.S.C. 154(b) by 502 days.

(21) Appl. No.: 13/985,137

(22) PCT Filed: Feb. 1, 2012

(86) PCT No.: PCT/IB2012/000216

§ 371 (c)(1),
(2), (4) Date: Aug. 13, 2013

(87) PCT Pub. No.: WO2012/110865

PCT Pub. Date: Aug. 23, 2012

(65) Prior Publication Data

US 2013/0323034 A1 Dec. 5, 2013

(30) Foreign Application Priority Data

Feb. 16, 2011 (JP) ..... 2011-030901

(51) Int. Cl.
*F01D 5/20* (2006.01)
*F01D 11/12* (2006.01)
(Continued)

(52) U.S. Cl.
CPC ..... *F01D 11/122* (2013.01); *F01D 5/20* (2013.01); *F04D 29/023* (2013.01);
(Continued)

(58) Field of Classification Search
CPC ..... F01D 11/122; F01D 5/20; F01D 5/10; F01D 5/3007; F04D 29/023; F04D 29/162; F04D 29/4206; F04D 29/328; F04D 29/666; F05D 2220/40; F05D 2230/10; C23C 28/04; C23C 28/3215; C23C 28/345; Y10T 428/263; Y10T 428/24967; Y10T 428/31678; Y10T 428/264; Y10T 428/26; Y02T 50/67; Y02T 50/672
(Continued)

(56) References Cited

U.S. PATENT DOCUMENTS

2006/0165524 A1 7/2006 Pellkofer et al.
2007/0020101 A1* 1/2007 Balamucki ..... F01D 5/10 416/219 R
(Continued)

FOREIGN PATENT DOCUMENTS

EP 1 746 249 A2 1/2007
JP 01-148001 U1 10/1989
(Continued)

OTHER PUBLICATIONS

International Search Report for corresponding International Patent Application No. PCT/IB2012/000216 mailed Apr. 11, 2012.

*Primary Examiner* — Thomas Denion
*Assistant Examiner* — Kelsey Stanek
(74) *Attorney, Agent, or Firm* — Sughrue Mion, PLLC

(57) ABSTRACT

In a compressor (11) of a turbocharger (1), a compressor wheel (14) is provided in a housing (12) to be capable of rotating. When the wheel (14) rotates, air suctioned through an inlet of the housing (12) is compressed and then discharged through an outlet of the housing (12). Further, an abradable seal layer (16) formed on an inner surface of the housing (12) is abraded by a vane (13) of the rotating wheel (14) such that a tip clearance between the vane (13) and a part of the inner surface of the housing (12) that opposes the vane (13) is adjusted. A corner portion (13*a*) of the vane (13) on the outlet side of the housing (12) is shaped to move gradually further away from a shroud curve (Lc) of the seal
(Continued)

layer (16) toward an end portion of the vane (13) on the outlet side of the housing (12).

3 Claims, 7 Drawing Sheets

(51) Int. Cl.
*F04D 29/02* (2006.01)
*F04D 29/16* (2006.01)
*F04D 29/42* (2006.01)

(52) U.S. Cl.
CPC ..... *F04D 29/162* (2013.01); *F04D 29/4206* (2013.01); *F05D 2220/40* (2013.01); *F05D 2230/10* (2013.01)

(58) Field of Classification Search
USPC ..... 415/173.4, 241 B; 416/219 R
See application file for complete search history.

(56) References Cited

U.S. PATENT DOCUMENTS

2007/0248457 A1 10/2007 Dodd et al.
2012/0063888 A1* 3/2012 Strock ..... C23C 28/04 415/173.4

FOREIGN PATENT DOCUMENTS

JP 03-052398 U1 5/1991
WO 2011/026468 A2 3/2011

* cited by examiner

ROTARY MACHINE

BACKGROUND OF THE INVENTION

1. Field of the Invention

The invention relates to a rotary machine.

2. Description of Related Art

In a conventional rotary machine such as a turbine or a compressor, an impeller, in which a plurality of vanes are provided in a housing, is provided to be capable of rotating about a shaft, and a fluid flowing into the housing passes between the vanes of the impeller and then flows out of the housing. The aforementioned turbine converts a kinetic energy of the fluid flowing through the housing into a rotary motion of the impeller. The aforementioned compressor suctions the fluid into the housing, compresses the fluid, and then discharges the fluid from the housing when the impeller is rotated.

To drive a rotary machine such as a turbine or a compressor efficiently, it is effective to reduce a tip clearance between a part of an inner surface of the housing that opposes the vanes of the impeller and the vanes themselves. It has been proposed for this purpose that the tip clearance between the part of the inner surface of the housing that opposes the vanes of the impeller and the vanes themselves be adjusted to a minimum value by forming an abradable seal layer on the inner surface of the housing and then abrading the layer using the vanes of the rotating impeller.

However, when a corner portion of each vane of the impeller on an outlet side of the housing abrades the abradable seal layer formed on the inner surface of the housing during adjustment of the tip clearance between the vane and the part of the inner surface of the housing that opposes the vane, a step is formed on the abraded part. When a step is formed on the abradable seal layer in this manner, the fluid flowing through the housing between the vanes of the impeller may stop flowing smoothly from the vicinity of the corner portion of the vane on the outlet side of the housing toward the outlet of the housing. As a result, it may be difficult to drive the rotary machine efficiently.

Hence, in Japanese Utility Model Application Publication No. 1-148001 (JP-U-1-148001), as shown in FIG. 6, when an abradable seal layer 52 is formed on an inner surface of a housing 51, a step 55 is formed in advance on the abradable seal layer 52 by causing a part of the abradable seal layer 52 corresponding to a vane 54 of an impeller 53 (a part that opposes the vane 54) to project further toward the vane 54 side than other parts. In this case, when the part of the abradable seal layer 52 that corresponds to the vane 54 is abraded by the vane 54 as the impeller 53 rotates, the step 55 formed on the abradable seal layer 52 by the projecting part is reduced. As a result, when a corner portion 54*a* of the vane 54 on an outlet side of the housing 51 abrades the abradable seal layer 52 formed on the inner surface of the housing 51, formation of a step on the abraded part can be suppressed.

However, even when the step 55 is formed in advance on the abradable seal layer 52, as in JP-U-1-148001, a part of the abradable seal layer 52 that is abraded by the corner portion 54*a* of the vane 54 on the outlet side of the housing 51 as the impeller 53 rotates is not always abraded by an amount corresponding to a height of the step 55.

The reason for this is that when the impeller 53 rotates, the impeller 53 may shake due to residual unbalance or the like in the impeller 53 of the rotary machine or dimensional tolerance and wear in components such as a shaft and a bearing for supporting the impeller 53 rotatably. In other words, when shaking (vibration) occurs in the rotating impeller 53, variation occurs in the amount by which the corner portion 54*a* of the vane 54 abrades the abradable seal layer 52 as the impeller 53 rotates. As a result, either the abradable seal layer 52 is abraded too shallowly by the corner portion 54*a* of the vane 54 such that the abrading amount is insufficient or the abradable seal layer 52 is abraded too deeply by the corner portion 54*a* of the vane 54 such that the abrading amount is excessive.

When the abrading amount of the abradable seal layer 52 is insufficient, the abrading amount does not reach the height of the step 55 on the abradable seal layer 52, and therefore the step 55 remains, as shown by a dotted line in FIG. 7A. When the abrading amount of the abradable seal layer 52 is excessive, the abrading amount exceeds the height of the step 55 on the abradable seal layer 52, and therefore a new step 56 is formed on the abradable seal layer 52, as shown by a dotted line in FIG. 7B.

When the abrading amount of the abradable seal layer 52 is insufficient such that the step 55 remains on the layer 52 (the dotted line in FIG. 7A), the step 55 causes a flow passage to widen rapidly in the vicinity of the step 55 when seen from the outlet side of the compressor. As a result, the fluid does not flow smoothly in the vicinity of the step 55, and therefore energy loss occurs in the fluid. When the abrading amount of the abradable seal layer 52 is excessive such that the new step 56 is formed on the layer 52 (the dotted line in FIG. 7B), the step 56 causes the flow passage to narrow rapidly in the vicinity of the step 56. As a result, the fluid does not flow smoothly in the vicinity of the step 56, and therefore energy loss occurs in the fluid. Hence, both when the step 55 remains on the abradable seal layer 52 and when the new step 56 is formed on the layer 52, the steps 55, 56 make efficient driving of the rotary machine difficult.

SUMMARY OF THE INVENTION

The invention provides a rotary machine in which formation of a step on an abradable seal layer formed on an inner surface of a housing can be suppressed when the abradable seal layer is abraded by vanes of a rotating impeller.

A first aspect of the invention relates to a rotary machine. In the rotary machine, an impeller includes vanes and an abradable seal layer is formed on a part of an inner surface of a housing that opposes the vanes, and the surface of the vane and the surface of the abradable seal layer, that oppose each other, are shaped to follow a predetermined shroud curve. When the impeller rotates, the abradable seal layer formed on the part of the inner surface of the housing that opposes the vanes is abraded by the vanes of the impeller. As a result, a tip clearance between the inner surface of the housing and the vanes of the impeller is adjusted to a minimum value.

Even when the impeller shakes (vibrates) or the like while the abradable seal layer is abraded by the vanes of the rotating impeller, such that variation occurs in an amount by which the vanes abrade the abradable seal layer, a corner portion of each vane on an outlet side of the housing impinges on the abradable seal layer in a part of the corner portion that opposes the inner surface of the housing. The reason for this is that the corner portion of each of the vanes on an outlet side of the housing is shaped such that a distance between the corner portion and the shroud curve of the abradable seal layer gradually increases toward an end portion of the vanes on the outlet side of the housing.

By forming the corner portion of the vane on the outlet side of the housing in this shape, all parts of the corner portion of the vane other than an end thereof on the outlet side of the housing impinge on the abradable seal layer so as to abrade the layer even when the impeller vibrates or the like such that variation occurs in the amount by which the vane abrades the abradable seal layer. Accordingly, formation of a step in the part of the abradable seal layer abraded by the corner portion of the vane can be suppressed, thereby preventing a situation in which a fluid no longer flows smoothly toward the outlet of the housing from the vicinity of the corner portion of the vane on the outlet side of the housing due to the step. As a result, a reduction in a driving efficiency of the rotary machine can be suppressed.

In a specific example of the shape of the corner portion of the vane on the outlet side of the housing, the corner portion may be shaped such that the end of the corner portion on the outlet side of the housing is withdrawn to a position removed from the shroud curve of the abradable seal layer by a predetermined distance, and so as to follow a tangent that passes through this position and contacts a shroud curve of the vane. When this shape is employed, a surface of the corner portion that opposes the abradable seal layer can be formed as a conical surface, and therefore the corner portion can be formed easily.

The aforesaid predetermined distance may be set at a value that corresponds to a maximum displacement amount generated when the impeller vibrates while rotating such that the vanes displace toward the abradable seal layer. By setting the predetermined distance in this manner, all parts of the corner portion other than the end thereof on the outlet side of the housing impinge on the abradable seal layer reliably even when the rotating impeller vibrates or the like, leading to variation in the amount by which the vanes abrade the abradable seal layer.

The impeller may be a component that suctions a fluid through an inlet of the housing, compresses the fluid, and then discharges the fluid through an outlet of the housing when driven to rotate about the shaft. In this case, the rotary machine functions as a compressor, and the fluid can be discharged from the rotary machine (the compressor) efficiently.

Further, the impeller and the housing may be provided on a compressor side of a turbocharger. Here, the impeller is rotated at high speed in the turbocharger, leading to an increase in the amount of fluid discharged from the compressor. Therefore, when the abradable seal layer formed on the inner surface of the housing is abraded such that a step is formed in the part of the abradable seal layer on the outlet side of the housing, the step has a great adverse effect on the efficiency with which the fluid is discharged from the turbocharger (the compressor). With the aspect described above, however, this adverse effect can be suppressed.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
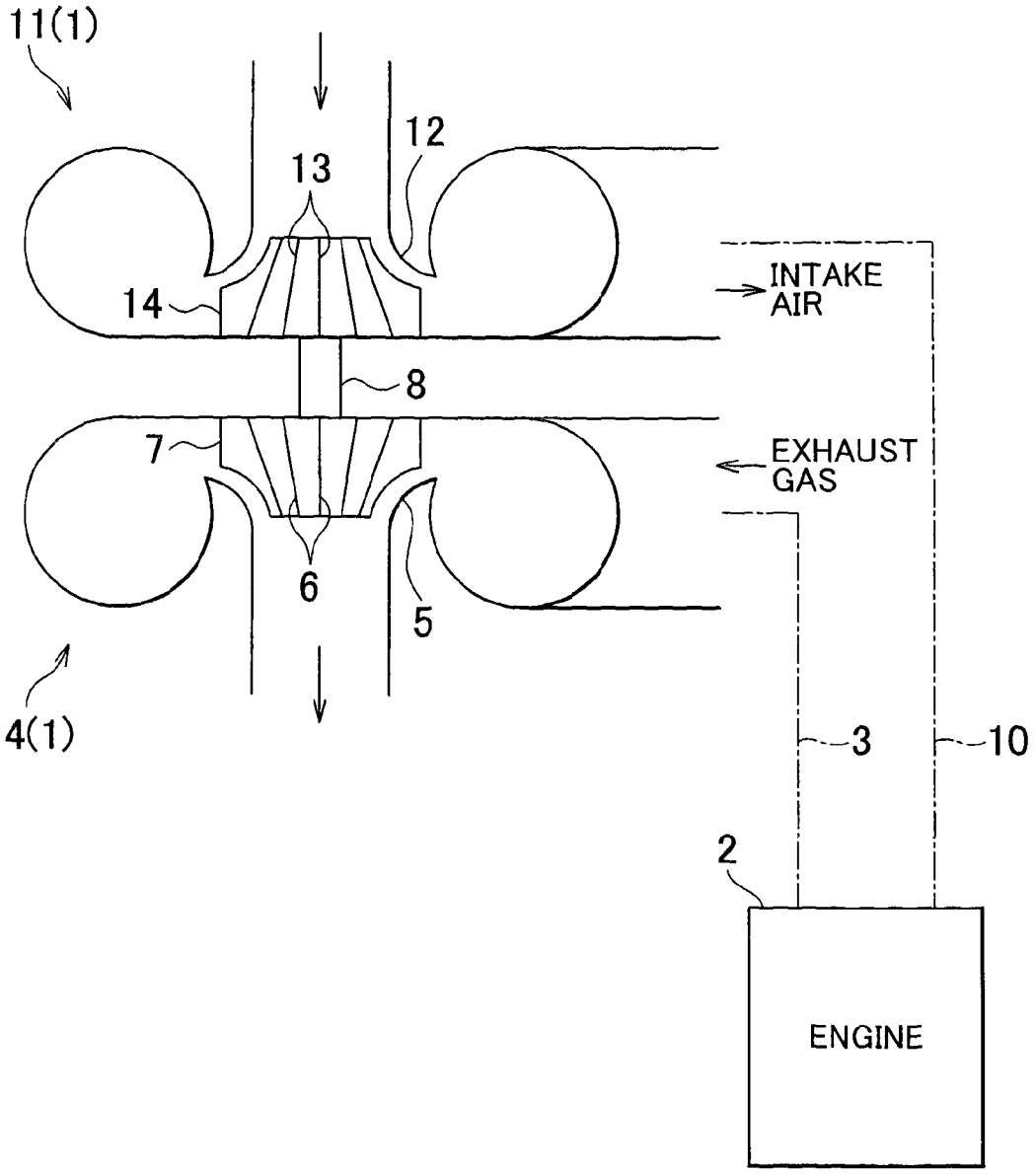
FIG. 1 is a schematic view showing a turbocharger according to an embodiment and an engine into which the turbocharger is incorporated.

A turbocharger incorporated into an automobile engine will be described below as a specific embodiment of the invention with reference to FIGS. 1 to 5. As shown in FIG. 1, a turbocharger 1 is provided with a turbine 4 connected to an exhaust passage 3 of an engine 2. An impeller (a turbine wheel) 7 including a plurality of vanes 6 is provided in a turbine housing 5 of the turbine 4 and fixed to a shaft 8 to be capable of rotating about the shaft 8. An exhaust gas of the engine 2 passes through the exhaust passage 3 and flows into the turbine housing 5 of the turbine 4. The exhaust gas flowing into the turbine housing 5 passes between the vanes 6 of the turbine wheel 7 and then flows through an outlet of the turbine housing 5 to the outside. The turbine 4 is a rotary machine that converts a kinetic energy of the exhaust gas flowing through the turbine housing 5 into a rotary motion of the turbine wheel 7 (the shaft 8).

The turbocharger 1 is further provided with a compressor 11 connected to an intake passage 10 of the engine 2. An impeller (a compressor wheel) 14 including a plurality of vanes 13 is provided in a compressor housing 12 of the compressor 11 and fixed to the shaft 8 to be capable of rotating about the shaft 8. The compressor 11 is a rotary machine that suctions air through an inlet of the compressor housing 12, compresses the air, and then discharges the compressed air through an outlet of the compressor housing 12 when the turbine 4 rotates the shaft 8 such that the compressor wheel 14 is rotated. The air passing through the compressor 11 passes between the vanes 13 of the compressor wheel 14 in the compressor housing 12, and then flows through an outlet of the compressor housing 12 to the outside.

In the engine 2 into which the turbocharger 1 is incorporated, the turbine wheel 7 of the turbocharger 1 is rotated using the kinetic energy of the exhaust gas flowing through the exhaust passage 3, and the air that is increased in pressure by the compressor wheel 14 rotating integrally with the turbine wheel 7 is fed to the engine 2 through the intake passage 10.

Figure 2:
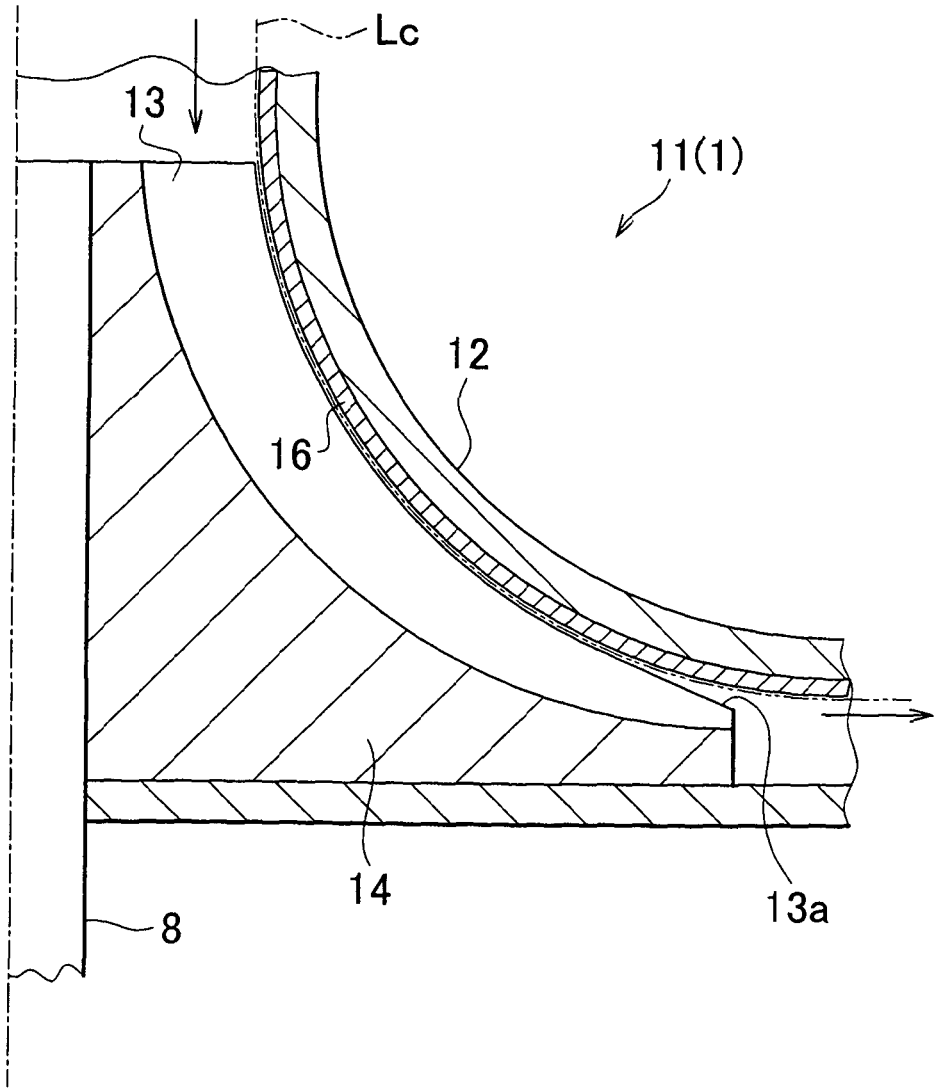
FIG. 2 is an enlarged sectional view showing a structure of a compressor wheel provided in a compressor of the turbocharger and the periphery thereof.

Next, the structure of the compressor wheel 14 provided in the compressor 11 of the turbocharger 1 and the periphery thereof will be described in detail with reference to FIG. 2. The plurality of vanes 13 (only one of which is shown in FIG. 2) of the compressor wheel 14 shown in the drawing are provided at equal intervals in a rotation direction of the shaft 8. The vanes 13 project from the compressor wheel 14 toward an inner surface of the compressor housing 12 and extend from the inlet side to the outlet side of the compressor housing 12. Further, an abradable seal layer 16 is formed on the inner surface of the compressor housing 12. The surface of the abradable seal layer 16 and the surface of the vane 13, which oppose each other, are shaped to follow a predetermined shroud curve Lc in the compressor housing 12. When the compressor wheel 14 rotates, the abradable seal layer 16 is abraded by the vanes 13 such that a tip clearance between a part of the inner surface of the compressor housing 12 that opposes the vanes 13 and the vanes 13 themselves is adjusted to a minimum value. By reducing the tip clearance between the part of the inner surface of the compressor housing 12 that opposes the vanes 13 and the vanes 13 themselves in this manner, the compressor 11 of the turbocharger 1 can be driven efficiently.

Figure 3:
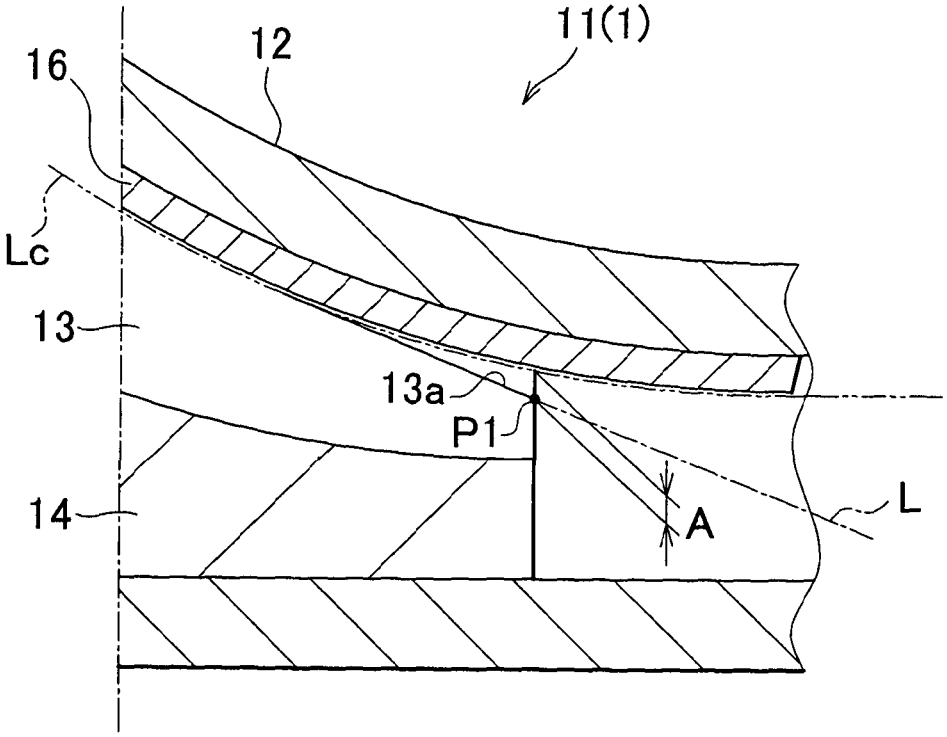
FIG. 3 is an enlarged sectional view showing a structure on the periphery of a corner portion of a vane of the compressor wheel on an outlet side of a compressor housing.

As shown in FIG. 3, a corner portion 13*a* of each vane 13 on the outlet side of the compressor housing 12 is shaped so as to move gradually further away from the shroud curve Lc of the abradable seal layer 16 toward an end portion (a right end portion in the drawing) of the vane 13 on the outlet side of the compressor housing 12. More specifically, the corner portion 13*a* is shaped such that an end of the corner portion 13*a* on the outlet side of the compressor housing 12 is withdrawn to a position P1 removed from the shroud curve Lc of the abradable seal layer 16 by a distance A, and so as to follow a tangent L that passes through the position P1 and contacts a shroud curve (a curve matching Lc) of the vane 13. Further, the distance A is set at a value that corresponds to a maximum displacement amount generated when the compressor wheel 14 shakes (vibrates) or the like while rotating such that the vane 13 displaces toward the abradable seal layer 16. Note that the compressor wheel 14 shakes while rotating due to factors such as residual unbalance or the like in the compressor wheel 14 and dimensional tolerance, wear, and so on in components such as the shaft 8 (FIG. 2) to which the compressor wheel 14 is fixed and a bearing for supporting the shaft 8.

Next, an action brought about in the compressor 11 of the turbocharger 1 by forming the corner portion 13*a* of the vane 13 on the outlet side of the compressor housing 12 in the shape described above will be described.

Figure 4:
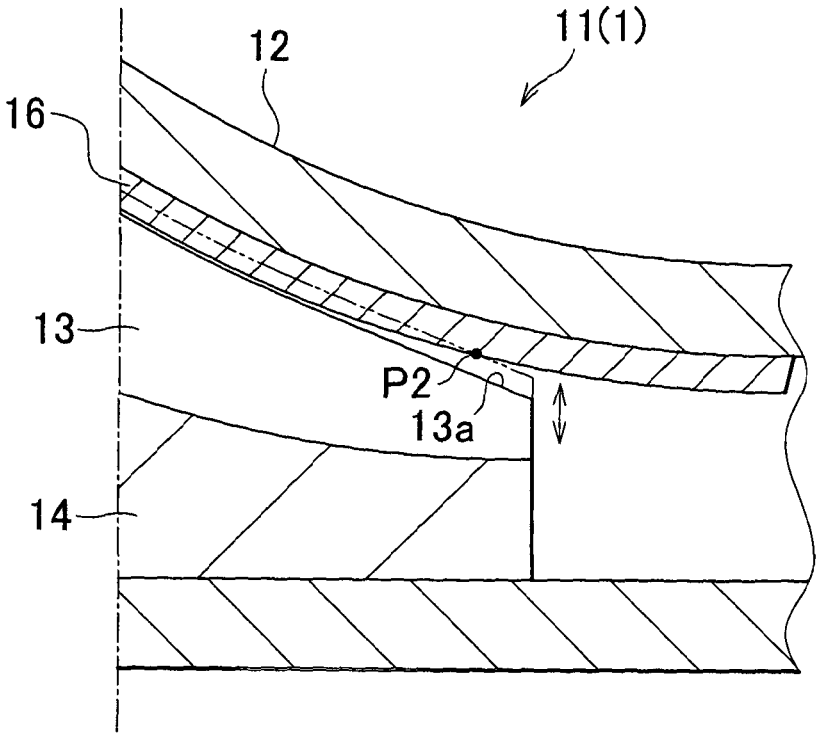
FIG. 4 is an enlarged sectional view showing a method of abrading an abradable seal layer formed on an inner surface of the compressor housing.

When the tip clearance between the inner surface of the compressor housing 12 shown in FIG. 2 and the vanes 13 of the compressor wheel 14 is adjusted, the abradable seal layer 16 formed on the inner surface of the compressor housing 12 is abraded by the vanes 13 of the rotating compressor wheel 14. At this time, however, shaking (vibration) and the like occur in the compressor wheel 14, leading to variation in an amount by which the vanes 13 abrade the abradable seal layer 16. More specifically, either the abradable seal layer 16 is abraded too shallowly by the vanes 13 such that the abrading amount is insufficient or the abradable seal layer 16 is abraded too deeply by the vanes 13 such that the abrading amount is excessive. However, even when variation occurs in the abrading amount of the abradable seal layer 16 in this manner, the corner portion 13*a* of the vane 13 on the outlet side of the compressor housing 12 impinges on the abradable seal layer 16 in a part of the corner portion 13*a* that opposes the inner surface of the compressor housing 12 as shown in FIG. 4.

Variation occurs in the abrading amount of the abradable seal layer 16 when the compressor wheel 14 shakes (vibrates) or the like such that the position of the corner portion 13*a* varies in the direction of an arrow in the drawing. In this case, in accordance with the position of the corner portion 13*a* in the direction of the arrow, an intersecting position P2 of the surface of the corner portion 13*a* and the surface the abradable seal layer 16, which oppose each other, displaces along the surface of the abradable seal layer 16 that opposes the corner portion 13*a* in a left-right direction of the drawing. However, even when the intersecting position P2 displaces in this manner, all parts of the corner portion 13*a* of the vane 13 other than the end thereof on the outlet side of the compressor housing 12 impinge on the abradable seal layer 16 so as to abrade the layer 16. As a result, formation of a step in the part (indicated by a dot-dot-dash line in the drawing) of the abradable seal layer 16 abraded by the corner portion 13*a* of the vane 13 can be suppressed, thereby preventing a situation in which air stops flowing smoothly from the vicinity of the corner portion 13*a* of the vane 13 toward the outlet of the compressor housing 12 due to the step. Further, a situation in which the compressor 11 cannot be driven efficiently because the air does not flow smoothly from the vicinity of the corner portion 13*a* of the vane 13 toward the outlet of the compressor housing 12 can be suppressed.

The improvement in the driving efficiency of the compressor 11 obtained in this embodiment will now be described with reference to a graph shown in FIG. 5. On the graph, a solid line L1 and a dotted line L2 show a relationship between an intake air amount of the engine 2 per unit time and a rotation speed of the turbocharger 1 under a condition where a turbocharging pressure of the engine 2 generated by driving the turbocharger 1 (the compressor 11), or in other words a pressure of the intake passage 10, is fixed at a predetermined value a. Further, a solid line L3 and a dotted line IA show the relationship between the intake air amount of the engine 2 per unit time and the rotation speed of the turbocharger 1 under a condition where the turbocharging pressure of the engine 2 generated by driving the turbocharger 1 (the compressor 11), or in other words the pressure of the intake passage 10, is fixed at a predetermined value b which is smaller than the predetermined value a. Note that the solid lines L1, L3 show this relationship in a case where the corner portion 13*a* of the vane 13 is formed in the shape shown in FIG. 3, while the dotted lines L2, L4 show this relationship in a case where the corner portion 13*a* of the vane 13 is formed in a shape corresponding to the shroud curve Lc.

Figure 5:
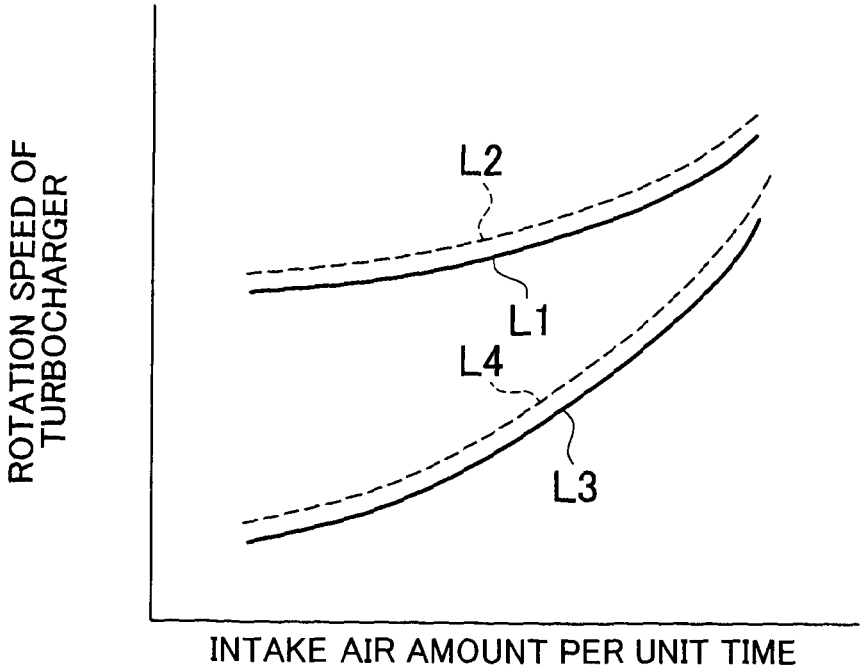
FIG. 5 is a graph showing a relationship between an intake air amount per unit time and a rotation speed of the turbocharger under a condition where a turbocharging pressure of the engine is fixed.
Figure 6:
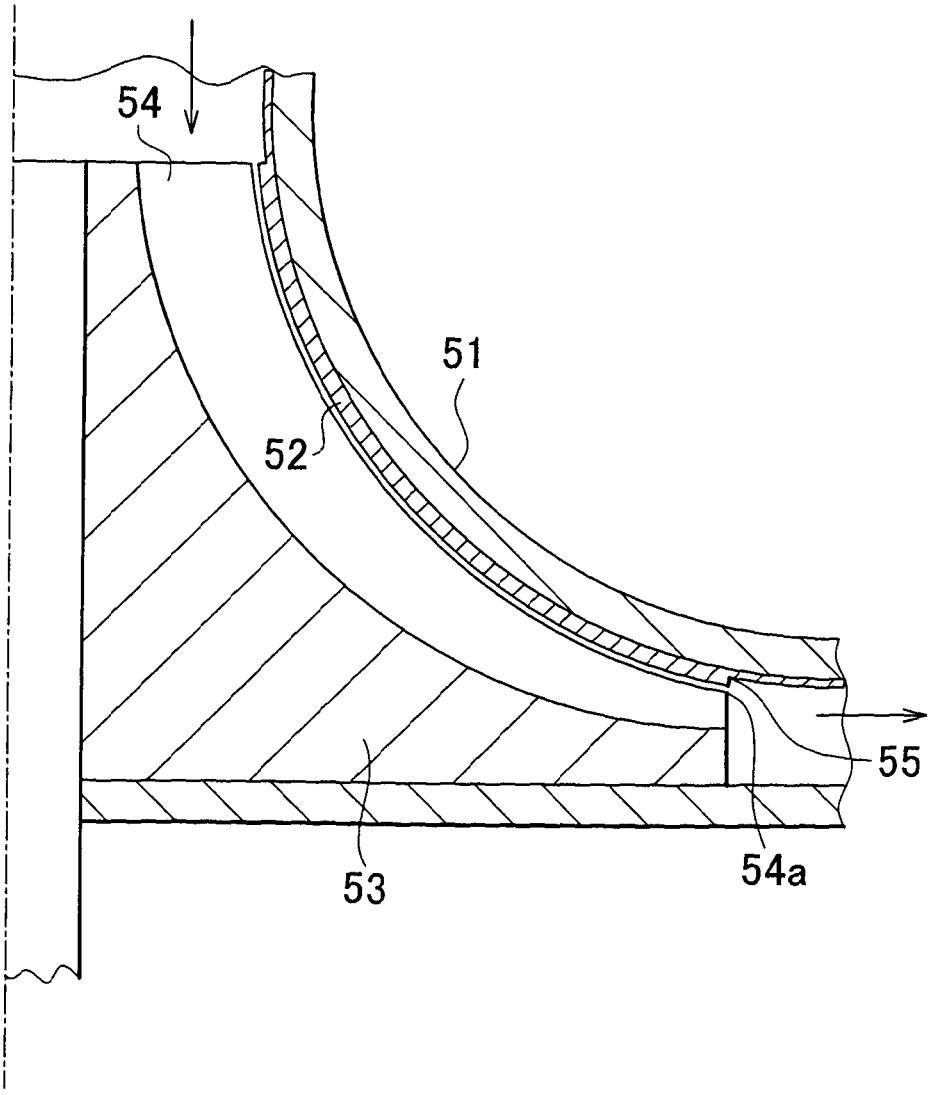
FIG. 6 RELATED ART
FIG. 6 is an enlarged sectional view showing a conventional example of a structure of an impeller provided in a rotary machine such as a compressor and the periphery thereof.
Figure 7A:
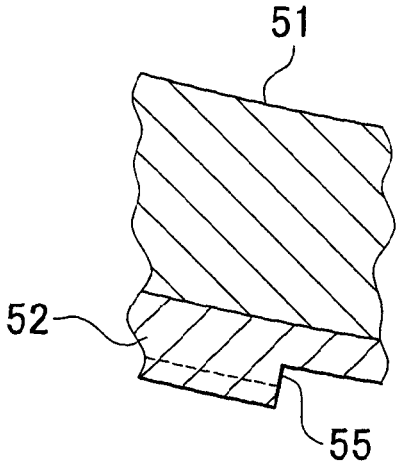
FIG. 7A RELATED ART
FIGS. 7A and 7B are enlarged sectional views showing variation in an abrading amount of an abradable seal layer formed on an inner surface of a housing accommodating the impeller.
Figure 7B:
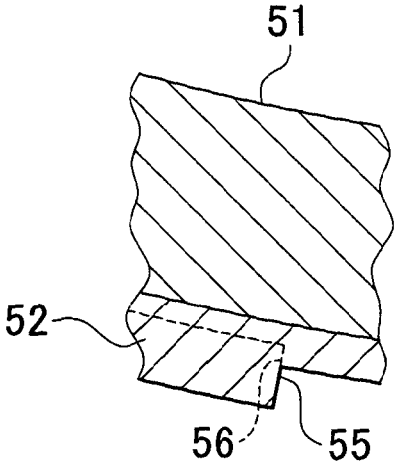
FIG. 7B RELATED ART

In FIG. 5, the solid line L1 is positioned further toward a reduced rotation speed side (a lower side of the drawing) of the turbocharger 1 than the dotted line L2 and the solid line L3 is positioned further toward the reduced rotation speed side of the turbocharger 1 than the dotted line L4. This indicates that a rotation speed of the turbocharger 1 required to fix the turbocharging pressure of the engine 2 at the predetermined value a or the predetermined value b is reduced. In other words, the turbocharging pressure of the engine 2 can be fixed at the predetermined value a or the predetermined value b even when the rotation speed of the turbocharger 1 is reduced, leading to an improvement in the driving efficiency of the compressor 11 of the turbocharger 1.

According to the embodiment described in detail above, effects illustrated below in (1) to (4) are obtained.

(1) In the compressor 11 of the turbocharger 1, formation of a step on the abradable seal layer 16 formed on the inner surface of the compressor housing 12 when the abradable seal layer 16 is abraded by the corner portion 13*a* of the vane 13 provided on the compressor wheel 14 can be suppressed in a case where the rotating compressor wheel 14 shakes (vibrates) or the like. Hence, a situation in which the compressor 11 cannot be driven efficiently because air does not flow smoothly from the vicinity of the corner portion 13*a* of the vane 13 toward the outlet of the compressor housing 12 due to the step can be prevented from occurring. In other words, the air can be discharged from the compressor 11 efficiently.

(2) The corner portion 13*a* is shaped such that the end of the corner portion 13*a* on the outlet side of the compressor housing 12 is withdrawn to the position P1 removed from the shroud curve Lc of the abradable seal layer 16 by the distance A, and so as to follow the tangent L that passes through the position P1 and contacts the shroud curve (a curve matching Lc) of the vane 13. By forming the corner portion 13*a* in this shape, the surface of the corner portion 13*a* that opposes the abradable seal layer 16 can be formed as a conical surface, and therefore the corner portion 13*a* can be formed easily.

(3) Further, the distance A is set at a value that corresponds to the maximum displacement amount generated when the compressor wheel 14 shakes (vibrates) or the like while rotating such that the vane 13 displaces toward the abradable seal layer 16. By setting the distance A in this manner, all parts of the corner portion 13*a* other than the end thereof on the outlet side of the compressor housing 12 impinge on the abradable seal layer 16 reliably even when the rotating compressor wheel 14 vibrates or the like such that the amount by which the vane 13 abrades the abradable seal layer 16 varies.

(4) In the turbocharger 1, the compressor wheel 14 is rotated at high speed, leading to an increase in the amount of air discharged from the compressor 11. Therefore, when the abradable seal layer 16 is abraded by the corner portion 13*a* such that a step is formed in the part of the layer 16 on the outlet side of the compressor housing 12, the step has a great adverse effect on the efficiency with which the air is discharged from the turbocharger 1 (the compressor 11). However, this adverse effect can be suppressed.

The embodiment described above may be modified as follows, for example. The distance A does not necessarily have to be set at a value that corresponds to the maximum displacement amount generated when the compressor wheel 14 shakes (vibrates) or the like while rotating such that the vane 13 displaces toward the abradable seal layer 16. If the distance A is to be modified from that of the embodiment, the distance A may be set at a larger value than the value corresponding to the maximum displacement amount.

The corner portion 13*a* does not necessarily have to be shaped so as to follow the tangent L passing through the position P1 in FIG. 3. For example, the corner portion 13*a* may be shaped to follow an arc-shaped curve that passes through the position P1 and contacts the shroud curve (a curve substantially matching Lc) of the vane 13.

Further, a corner portion of the vane 13 of the compressor wheel 14 on the inlet side of the compressor housing 12 may be formed similarly to the corner portion 13*a* on the outlet side. In this case, the inlet side corner portion is shaped so as to move gradually further away from the shroud curve Lc of the abradable seal layer 16 toward an end of the vane 13 on the inlet side of the compressor housing 12. By forming the inlet side corner portion in this shape, all parts of this corner portion of the vane 13 other than an end thereof on the inlet side of the compressor housing 12 impinge on the abradable seal layer 16 so as to abrade the layer 16 even when the compressor wheel 14 shakes (vibrates) or the like such that variation occurs in the amount by which the vane 13 abrades the abradable seal layer 16. Accordingly, formation of a step in the part of the abradable seal layer 16 abraded by the corner portion of the vane 13 can be suppressed, thereby preventing a situation in which air is no longer suctioned smoothly into the vicinity of the inlet side corner portion of the vane 13 from the inlet side of the compressor housing 12 due to the step. As a result, a reduction in the driving efficiency of the compressor 11 can be suppressed.

Furthermore, the invention may be applied to the turbine 4 of the turbocharger 1. In this case, an abradable seal layer is formed on an inner surface of the turbine housing 5, and the surface of the abradable seal layer and the surface of the vane 6 of the turbine wheel 7, which oppose each other, are shaped to follow a shroud curve of the turbine housing 5. Further, a corner portion of each vane 6 of the turbine wheel 7 is formed in a similar shape to the corner portion of the vane 13 provided on the compressor wheel 14 according to the above embodiment. In this case, a corner portion of the vane 6 on an outlet side of the turbine housing 5 is shaped so as to move gradually further away from the shroud curve of the abradable seal layer toward an end of the vane 6 on the outlet side of the turbine housing 5. By forming the outlet side corner portion of the vane 6 in this shape, all parts of this corner portion of the vane 6 other than the end thereof on the outlet side of the turbine housing 5 impinge on the abradable seal layer so as to abrade the layer even when the turbine wheel 7 shakes (vibrates) or the like such that variation occurs in the amount by which the vane 6 abrades the abradable seal layer. Accordingly, formation of a step in the part of the abradable seal layer abraded by the outlet side corner portion of the vane 6 can be suppressed, thereby preventing a situation in which the exhaust gas no longer flows smoothly from the vicinity of the outlet side corner portion of the vane 6 toward the outlet of the turbine housing 5 due to the step. As a result, a reduction in a driving efficiency of the turbine 4 can be suppressed.

Note that when the invention is applied to the turbine 4, as described above, the corner portion of the vane 6 on an inlet side of the turbine housing 5 may be formed as follows.

The inlet side corner portion may be shaped so as to move gradually further away from the shroud curve of the abradable seal layer toward an inlet side end of the vane 6. By forming the inlet side corner portion in this shape, all parts of this corner portion of the vane 6 other than the end thereof on the inlet side of the turbine housing 5 impinge on the abradable seal layer so as to abrade the layer even when the turbine wheel 7 shakes (vibrates) or the like such that variation occurs in the amount by which the vane 6 abrades the abradable seal layer. Accordingly, formation of a step in the part of the abradable seal layer abraded by the corner portion of the vane 6 can be suppressed, thereby preventing a situation in which the exhaust gas no longer flows smoothly to the vicinity of the corner portion from the inlet side of the turbine housing 5 due to the step. As a result, a reduction in the driving efficiency of the turbine 4 can be suppressed.

The invention may also be applied to a rotary machine such as a compressor or a turbine of a member other than a turbocharger.

The invention claimed is:

1. A rotary machine comprising:

a housing; and an impeller having a plurality of vanes and provided in the housing to be rotatable about a shaft, wherein a fluid that flows into the housing passes between the vanes of the impeller and then flows out of the housing, an abradable seal layer, which is abraded by each of the vanes to adjust a tip clearance between the abradable seal layer and the vanes when the impeller rotates, is provided on an inner surface of the housing such that a surface of each of the vanes and a surface of the abradable seal layer, which oppose each other, are shaped to follow a predetermined shroud curve, and a corner portion of each of the vanes on an outlet side of the housing is shaped such that a distance between the corner portion and the shroud curve of the abradable seal layer gradually increases toward an end portion of the vanes on the outlet side of the housing, wherein the corner portion of each of the vanes on the outlet side of the housing is shaped such that an end of the corner portion on the outlet side of the housing is withdrawn to a position removed from the shroud curve of the abradable seal layer by a predetermined distance, and so as to follow a tangent that passes through the position and contacts a shroud curve of the vane, wherein the predetermined distance is set at a value that corresponds to a maximum displacement amount generated when the impeller vibrates while rotating such that the vanes displace toward the abradable seal layer.

2. The rotary machine according to claim 1, wherein the impeller suctions the fluid through an inlet of the housing, compresses the fluid, and then discharges the fluid through an outlet of the housing when driven to rotate about the shaft.

3. The rotary machine according to claim 2, wherein the impeller and the housing are provided on a compressor side of a turbocharger.

* * * * *